US007591709B2

(12) United States Patent
Shimizu et al.

(10) Patent No.: US 7,591,709 B2
(45) Date of Patent: Sep. 22, 2009

(54) BLASTING DEVICE

(75) Inventors: Tokuo Shimizu, Tokyo (JP); Tetsunori Yano, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 50 days.

(21) Appl. No.: 11/844,498

(22) Filed: Aug. 24, 2007

(65) Prior Publication Data

US 2008/0070486 A1 Mar. 20, 2008

(30) Foreign Application Priority Data

Sep. 14, 2006 (JP) ..... 2006-249610

(51) Int. Cl.
*B24B 49/00* (2006.01)

(52) U.S. Cl. ..... 451/8; 451/99

(58) Field of Classification Search ..... 451/38, 451/39, 90, 99

See application file for complete search history.

(56) References Cited

U.S. PATENT DOCUMENTS

| | | | | | |
|---|---|---|---|---|---|
| 925,591 | A * | 6/1909 | Pangborn et al. | ..... | 451/99 |
| 2,553,625 | A * | 5/1951 | Andersen | ..... | 451/99 |
| 2,876,601 | A * | 3/1959 | McFaddan | ..... | 451/40 |
| 3,019,522 | A * | 2/1962 | Bluth et al. | ..... | 451/41 |
| 3,266,193 | A * | 8/1966 | McCune | ..... | 451/99 |
| 4,685,868 | A * | 8/1987 | Bodensteiner et al. | ..... | 417/405 |
| 5,123,206 | A * | 6/1992 | Woodson | ..... | 451/39 |
| 5,181,349 | A * | 1/1993 | Schaffer | ..... | 451/75 |
| 5,239,788 | A * | 8/1993 | Woodson | ..... | 451/39 |
| 6,200,202 | B1 * | 3/2001 | Eastman et al. | ..... | 451/99 |
| 6,547,646 | B2 * | 4/2003 | Eastman et al. | ..... | 451/41 |
| 6,793,563 | B2 * | 9/2004 | Daniel | ..... | 451/90 |
| 6,857,944 | B2 * | 2/2005 | Linde et al. | ..... | 451/75 |
| 7,040,962 | B2 * | 5/2006 | Makino et al. | ..... | 451/39 |

FOREIGN PATENT DOCUMENTS

| | | | |
|---|---|---|---|
| JP | 61207718 | A * | 9/1986 |
| JP | 08323178 | A * | 12/1996 |
| JP | 2005-66724 | A | 3/2005 |
| RU | 2208096 | C2 * | 7/2003 |

* cited by examiner

*Primary Examiner*—Maurina Rachuba
(74) *Attorney, Agent, or Firm*—David S. Safran; Roberts Mlotkowski Safran & Cole, P.C.

(57) ABSTRACT

The present invention provides a blasting device, comprising: a container in which a blast medium is stored; a suction pipe which is inserted in the container to be rotatably supported, and is formed substantially in an L-shape with a lower suction port bent at a right angle; a rotary drive part which rotates the suction pipe; a hose connected to the suction pipe via a rotary joint; an ejector nozzle connected to the hose; an air compressor which supplies compressed air to the ejector nozzle; a pressure sensor which measures pressure in the suction pipe; and a control part which controls a rotational frequency of the suction pipe by the rotary drive mechanism based on a measured value by the pressure sensor.

14 Claims, 6 Drawing Sheets

BLASTING DEVICE

BACKGROUND OF THE INVENTION

1. Field of the Invention

The present invention relates to a blasting device, and particularly relates to a blasting device which is for carrying out a blasting operation and easy to carry.

2. Description of the Related Art

On the occasion of recoating a coated wall surface, a blasting operation of preparing the surface by grinding the coating film on the wall surface, and roughening the coated surface is performed as preliminary work. The blast medium which is used in such an occasion is generally sand or steel as in Japanese Patent Application Laid-Open No. 2005-66724, but recently, a method of using a blast medium in the shape of a sponge piece with an abrasive bonded inside a porous elastic body, a so-called sponge blast method has attracted attention from the viewpoint of improvement in a working environment.

According to the sponge blast method, when the sponge blast medium ejected from a nozzle with high-speed air collides against a coated surface, the blast medium becomes flat, and the abrasive mixed therein directly collides against the coated surface at a high speed. Therefore, the coating film can be ground and removed as with a sand and steel blast method. Since generated powder dust is entrapped in the sponge, the advantage of improving a working environment is provided.

Incidentally, in the structure of the above described conventional blasting device, the force feeding device for blast medium is constituted of large devices such as the pressure tank and the blower of the main body, and therefore, much time is required for setup and much effort is also required. For the blasting operation for a region having a large area, the number of process steps required for the setup and the blasting operation efficiency can be kept in balance. However, for the blasting operation for a region having a small area, the blasting operation takes a short time as compared with the setup time, and therefore, the conventional blasting device has the disadvantage of the balance being extremely unfavorable.

SUMMARY OF THE INVENTION

The present invention is made in view of the above circumstances, and has an object to provide a blasting device which is capable of reducing the number of process steps of setup, that is, easy to carry.

In order to attain the above described object, a first aspect of the present invention is characterized by including a container in which a blast medium is stored, a suction pipe which is inserted in the container to be rotatably supported, and is formed substantially in an L-shape with a lower suction port bent at a right angle, a rotary drive part which rotates the suction pipe, a hose connected to the suction pipe via a rotary joint, an ejector nozzle connected to the hose, and an air compressor which supplies compressed air to the ejector nozzle.

The first aspect of the present invention provides a compact and simple blasting device by using the air compressor which sucks the blast medium by negative pressure and ejects the blast medium, in place of the large-sized blower conventionally used, in order to reduce the number of setup process steps.

Specifically, according to the first aspect of the present invention, the suction pipe is rotated in the blast medium stored in the container by the drive force from the rotary drive part. Since large rotational torque is required in this case, the operation of advancing the lower suction port while rotating the lower suction port to the place where the blast medium is removed, in a word, is performed, while sucking the blast medium from the lower suction port of the suction pipe. Suction of the blast medium is performed by utilizing the ejector effect which occurs as a result of supplying the compressed air from the air compressor to the ejector nozzle. Thereby, the blast medium which is sucked is guided to the hose connected to the suction pipe via a rotary joint, and is ejected from the ejector nozzle. According to the blasting device with such a constitution, the air compressor is used in place of the large-sized blower as described above, and the structure of sucking the blast medium by negative pressure by rotating the suction pipe in the container is adopted. Therefore, the number of setup process steps can be significantly reduced, and the blasting device is easy to carry. Thus, the blasting device is favorable for a blasting operation for a region with a small area.

A second aspect of the present invention is, in the first aspect, characterized by having a pressure sensor which measures pressure in the suction pipe, and a control part which controls a rotational frequency of the suction pipe by the rotary drive mechanism based on a measured value by the pressure sensor.

When the rotating speed of the suction pipe is higher than the suction rate of the blast medium, the blast medium is lodged in the suction pipe and the negative pressure inside the suction pipe becomes too high. Therefore, it is necessary to rotate the suction pipe while keeping proper negative pressure. According to the second aspect of the present invention, the pressure sensor is provided at a part of the suction pipe, and the control part controls the rotary drive mechanism based on the measured value measured by this pressure sensor to control the rotational frequency of the suction pipe to be a rotational frequency at which clogging does not occur to the suction pipe. Thereby, the blast medium is favorably ejected from the ejector nozzle without lodging in the suction pipe.

A third aspect of the present invention is, in the first and second aspects, characterized by having an inclined plate disposed at the lower suction port of the suction pipe to be spaced by a predetermined amount, and disposed to be inclined at a downstream side with respect to a rotating direction of the lower suction port.

According to the third aspect of the present invention, when the suction pipe rotates with the inclined plate pushing away the blast medium, an empty space is formed in a gap between a back surface of the inclined plate and the lower suction port, and due to this empty space, suction of the blast medium from the lower suction port easily occurs. Therefore, by providing the inclined plate, the blast medium can be stably sucked.

A fourth aspect of the present invention is, in the third aspect, characterized by having an adjusting member which adjusts an inclination angle of the inclined plate.

According to the fourth aspect of the invention, the inclination angle of the inclined plate can be set at an angle at which the blast medium can be easily sucked in accordance with the kind (sand, steel and sponge) of the blast medium.

A fifth aspect of the present invention is, in the fourth aspect, characterized in that the inclined plate is formed into a comb shape.

According to the fifth aspect of the present invention, the blast medium can be taken into the gap from gaps of the comb teeth of the inclined plate. In this case, this is not preferable for the blast medium such as sand and steel, since the gaps are sometimes blocked, but in the case of the sponge blast medium, this is preferable since the gaps are not completely blocked, and the sponge blast medium is loosened by the comb teeth.

A sixth aspect of the present invention is, in the fifth aspect, characterized by being provided with an opening area changing device which makes opening areas between comb teeth portions of the inclined plate variable.

According to the sixth aspect of the present invention, by making the opening areas between the comb teeth portions of the inclined plate variable, the suction rate of the blast medium, especially the sponge blast medium can be controlled.

A seventh aspect of the present invention is, in the second to the sixth aspects, characterized in that the control part conducts control to supply compressed air from the air compressor to a part of the hose other than the ejector nozzle as supplementary compressed air to suck the blast medium in the suction pipe by an ejector effect to feed it into the hose when the measured value by the pressure sensor exceeds a predetermined value, and conducts control to stop the supply of the supplementary compressed air to the hose when the measured value by the pressure sensor becomes the predetermined value or less.

According to the seventh aspect of the present invention, a blasting operation is usually performed by supplying compressed air to the ejector nozzle from the air compressor, but when the negative pressure of the suction pipe exceeds the predetermined value to be large, but the ejection amount of the blast medium is comparatively small, the compressed air is also supplied to a part of the hose from the air compressor as the supplementary compressed air. Thereby, the blast medium in the suction pipe is sucked by the ejector effect and is fed to the hose. After that, when the negative pressure of the suction pipe returns to the original favorable numerical value, and the ejection amount returns to normality, the supply of the supplementary compressed air to the hose is stopped. The supplementary compressed air may be always supplied to a part of the hose, but by supplying it only when it is required, energy conservation can be achieved.

According to the blasting device according to the present invention, the air compressor is used in place of a large-sized blower, and the structure of sucking the blast medium by negative pressure by rotating the suction pipe inside the container is adopted. Therefore, the number of setup process steps can be significantly reduced, and the blasting device becomes easy to carry. Accordingly, the blasting device which is favorable for a blasting operation for a region with a small area can be provided.

DETAILED DESCRIPTION OF THE PREFERRED EMBODIMENTS

A preferred embodiment of a blasting device according to the present invention will be described in detail hereinafter in accordance with the attached drawings.

Figure 1:
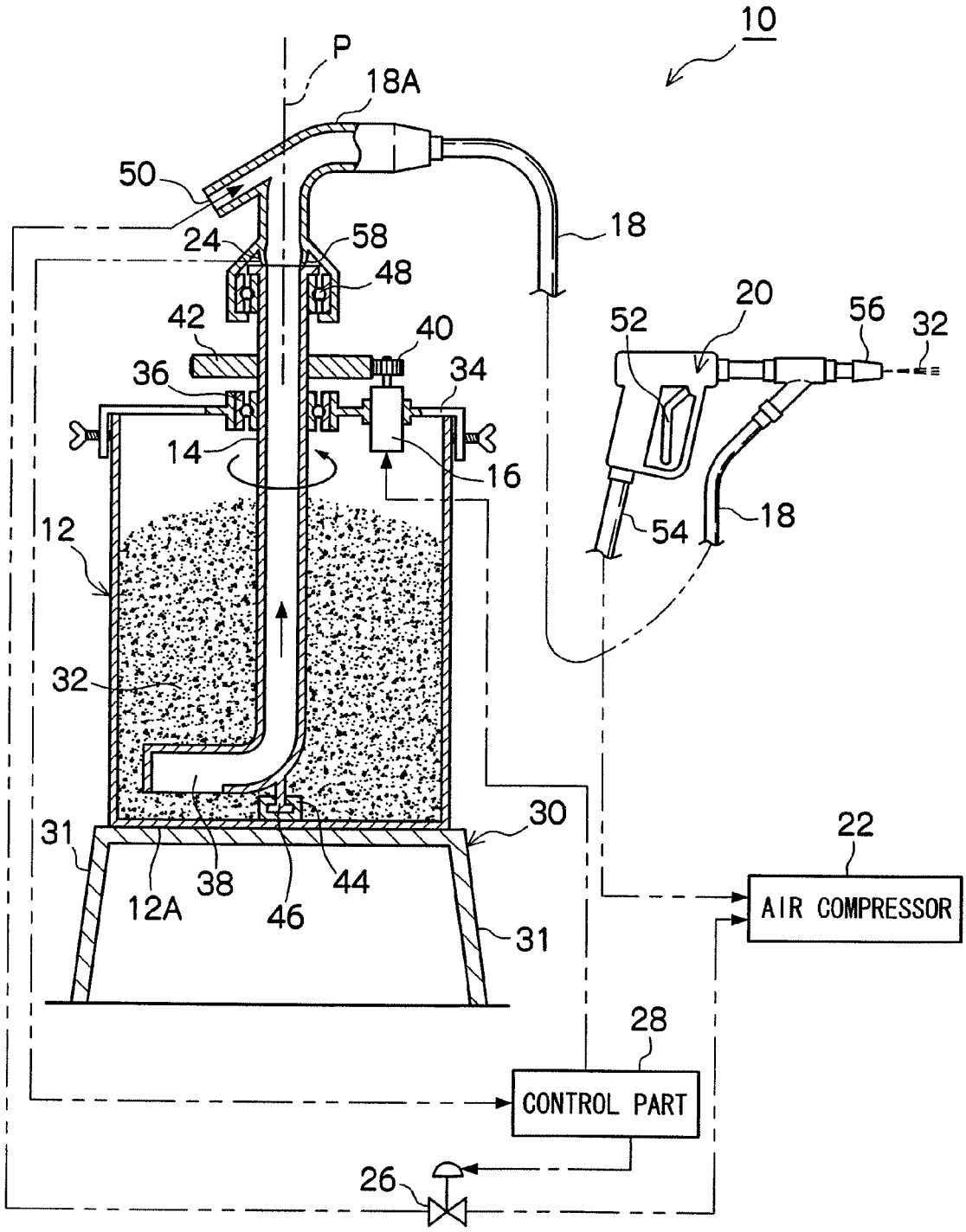
FIG. 1 is an explanatory view showing an entire constitution of a blasting device of an embodiment.
Figure 2:
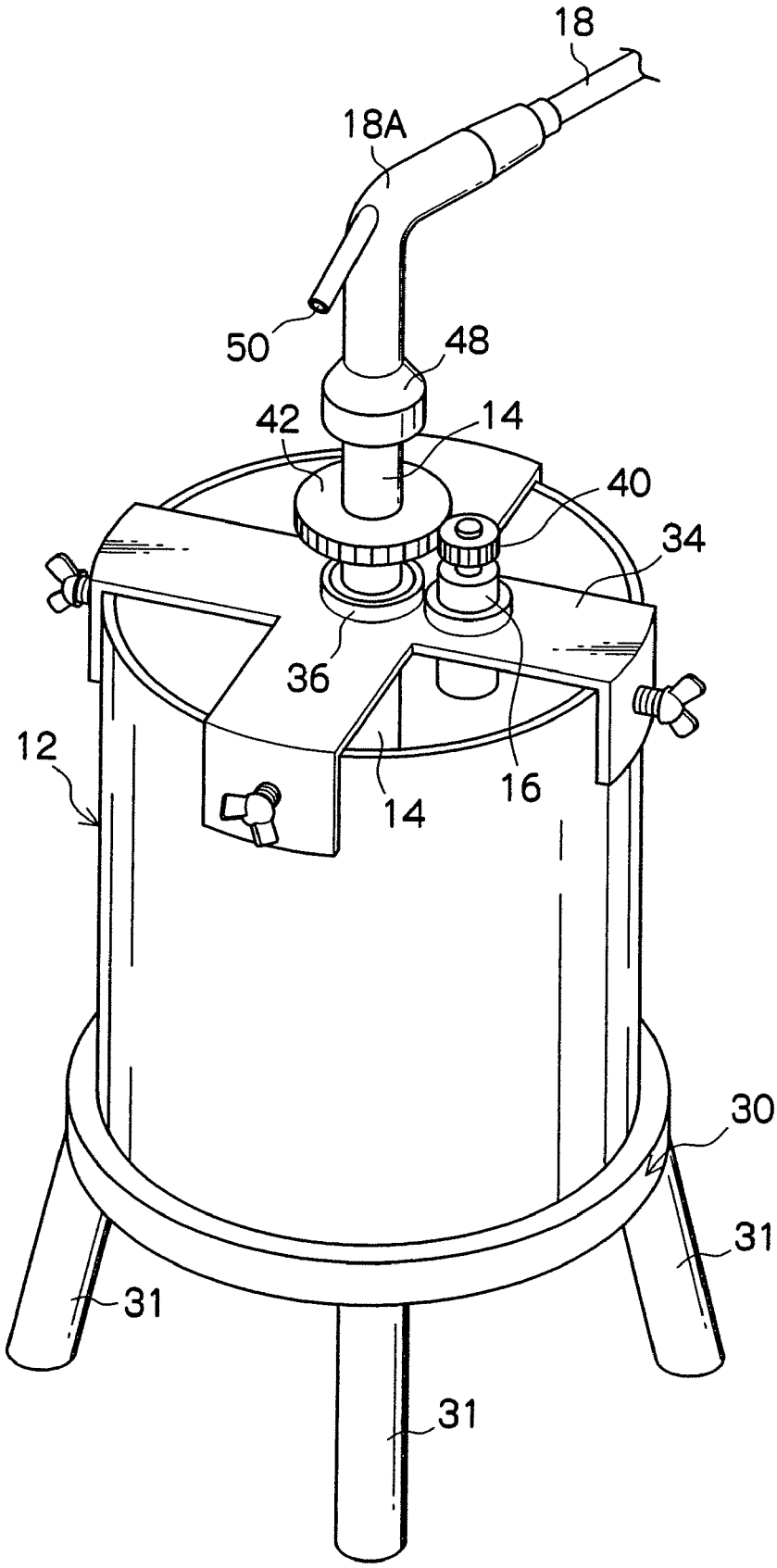
FIG. 2 is a perspective view of a container of the blasting device shown in FIG. 1.

FIG. 1 is an explanatory view showing an entire constitution of a blasting device 10 of the embodiment. FIG. 2 is a perspective view showing a container 12 of the blasting device 10.

As shown in these drawings, the blasting device 10 is constituted of a cylindrical container 12, a suction pipe 14, a motor (rotary drive part) 16, a hose 18, an ejector nozzle 20, an air compressor 22, a negative pressure sensor (pressure sensor) 24, a valve 26, a control part 28 and the like.

The container 12 is installed on a seat 30, and a sponge blast medium 32 that is a blast medium is stored in it. By providing casters at lower portions of three leg portions 31, 31 and 31 of the seat 30, the container 12 can be easily moved to a desired position. As a blast medium, a sponge blast 32 is shown as an example, but the blast medium is not limited to this, and it may be other blast media such as sand and steel.

Figure 3:
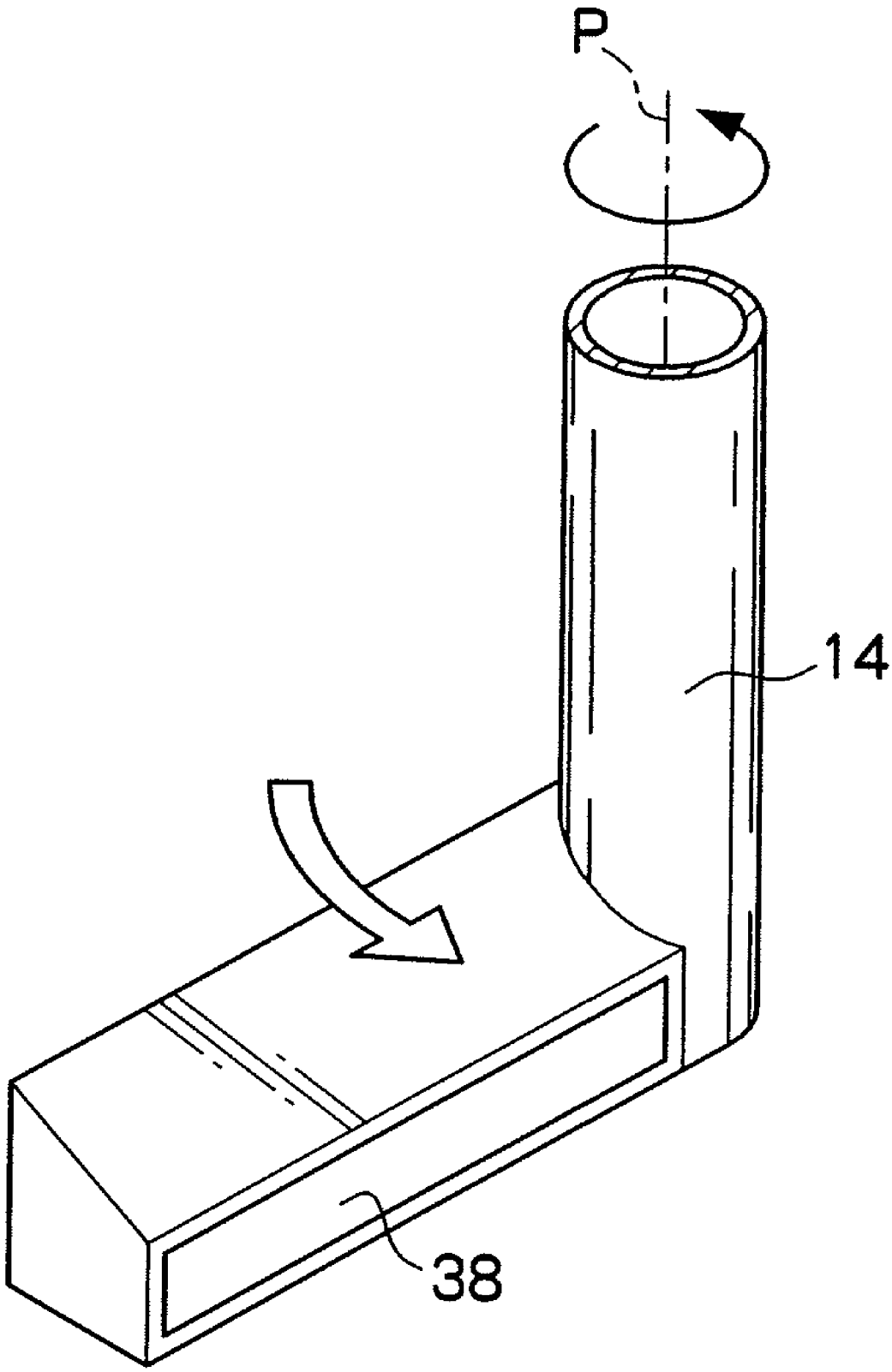
FIG. 3 is a perspective view showing a lower suction port of a suction pipe of the blasting device shown in FIG. 1.

The suction pipe 14 is inserted into the container 12 along a center axis P of the container 12, and is rotatably supported via a bearing 36 by a plate 34 in the shape of a cross which is fixed to an upper opening of the container 12 by screws. At a lower portion of the suction pipe 14, a lower suction port 38 is bent at the right angle as shown in FIG. 3, so that the entire suction pipe 14 is formed substantially in an L-shape. The lower suction port 38 is disposed with a predetermined gap with respect to a bottom surface 12A (see FIG. 1) of the container 12.

As shown in FIG. 2, the motor 16 is fixed to the plate 34, and a gear 40 is fixed to its rotary shaft. The gear 40 is meshed with a gear 42 fixed to the suction pipe 14. Accordingly, when the power of the motor 16 is transmitted to the suction pipe 14 via the gears 40 and 42, the suction pipe 14 is rotated around the center axis P. In order to guide the rotation smoothly, a bearing part 44 is provided at a center portion of the bottom surface 12A of the container 12, and a lower protruded portion 46 of the suction pipe 14 is rotatably supported by the bearing part 44.

A base end portion 18A of the hose 18 is connected to an upper portion of the suction pipe 14 via a rotary joint 48, and an ejector nozzle 20 is connected to a tip end portion of the hose 18. The base end portion 18A of the hose 18 has an ejector structure (FIG. 1 does not show the details), and a compressed air supply port 50 of it is connected to an air compressor 22 via a valve 26.

The ejector nozzle 20 is of a gun type having a lever (trigger) 52, and is connected to the air compressor 22 via an air hose 54. When an operator triggers the lever 52, a nozzle (not shown) incorporated in the ejector nozzle 20 is opened, and thereby, the compressed air from the air compressor 22 is introduced into the ejector nozzle 20. By the ejector effect caused by this, the sponge blast medium 32 in the container 12 is sucked into the ejector nozzle 20 through the suction pipe 14 and the hose 18, and is ejected from an ejection port 56 of the ejector nozzle 20 together with the compressed air.

A negative pressure sensor 24 is provided near a seal 58 which shields the rotary joint 48 and the base end portion 18A of the hose 18, and is mounted to a position at which it can measure the negative pressure inside the suction pipe 14. The information indicating the negative pressure measured by the negative pressure sensor 24 is outputted to a control part 28. The control part controls the rotational frequency of the motor 16 and opening and closing of the valve 26 based on the information.

An operation of the blasting device 10 constituted as described above will be described next.

First, the blasting device 10 of the embodiment uses the air compressor 22 which sucks the sponge blast medium 32 by negative pressure and ejects it instead of a large-sized blower conventionally used in order to reduces the number of setup process steps. Thereby, the compact and simple blasting device 10 is provided.

Specifically, the blasting device 10 of the embodiment rotates the suction pipe 14 at a predetermined rotational frequency by the drive force of the motor 16 in the sponge blast medium 32 stored in the container 12. In this case, the sponge blast medium 32 becomes the resistance, and large rotational torque is required for rotation of the suction pipe 14. Therefore, the operation of advancing the lower port 38 to a place where the sponge blast medium 32 is removed while rotating it, in a word, is performed while sucking the sponge blast medium 32 from the lower suction port 38 of the suction pipe 14, by using the ejector effect which is caused by supplying the compressed air to the ejector nozzle 20 from the air compressor 22.

The sponge blast medium 32 sucked by the ejector effect is guided to the hose 18 connected to the suction pipe 14 through the rotary joint 48, and is ejected from the ejection port 56 of the ejector nozzle 20.

According to the blasting device 10 constituted like this, the air compressor 22 is used instead of a large-sized blower as described above, and the structure of sucking the sponge blast medium 32 by negative pressure by rotating the suction pipe 14 in the container 12 is adopted. Therefore, the blasting device 10 is favorable for a blasting operation for a region with a small area since the number of setup process steps can be significantly reduced, and the blasting device 10 is easy to carry.

When the rotational speed of the suction pipe 14 is higher than the suction rate of the sponge blast medium 32, the suction pipe 14 is clogged with the sponge blast medium 32, and the negative pressure in the suction pipe 14 becomes too high. Therefore, it is necessary to rotate the suction pipe 14 while keeping proper negative pressure.

In the blasting device 10 of this embodiment, the control part 28 controls the motor 16 based on the negative pressure inside the suction pipe 14 which is measured by the negative pressure sensor 24, and controls the rotational frequency of the suction pipe 14 to be the rotational frequency at which the suction pipe 14 is not clogged. Specifically, the control part 28 properly controls the rotational frequency of the suction pipe 14 so that the negative pressure measured by the negative pressure sensor 24 becomes the negative pressure which gives a proper suction force. Thereby, the sponge blast medium 32 is favorably ejected from the ejector nozzle 20 without lodging in the suction pipe 14.

When the measured value by the negative pressure sensor 24 is lower than a fixed value (the value at which the suction pipe 14 is assumed to be surely clogged with the sponge blast medium 32), the control part 28 opens the valve 26, and also supplies the compressed air from the air compressor 22 to the base end portion 18A of the hose 18 as supplemental compressed air. Thereby, the ejector effect occurs in the base end portion 18A of the hose 18, and by this ejector effect, the sponge blast medium 32 lodged in the suction pipe 14 is forcefully sucked by the hose 18. Thereby, clogging in the suction pipe 14 is eliminated. When the measured value by the negative pressure sensor 24 returns to the above described fixed value, the control part 28 determines that the clogging is eliminated and closes the valve 26, and stops the supply of the supplemental compressed air to the base end portion 18A of the hose 18.

Specifically, the blasting device 10 of the embodiment usually performs a blasting operation by supplying the compressed air to the ejector nozzle 20 from the air compressor 22, but when the negative pressure of the suction pipe 14 becomes lower than the fixed value, it determines that clogging occurs to the suction pipe 14, and also supplies the compressed air to the base end portion 18A of the hose 18 from the air compressor 22 as the supplemental compressed air.

Thereby, the sponge blast medium 32 lodged in the suction pipe 14 is sucked due to the ejector effect and is fed into the hose 18. After that, when the negative pressure of the suction pipe 14 returns to the original favorable numerical value, supply of the supplemental compressed air to the suction pipe 14 is stopped. The compressed air from the air compressor 22 may be always supplied to the hose 18 as the supplemental compressed air, but by supplying it only when it is needed, energy conservation can be achieved.

Figure 4:
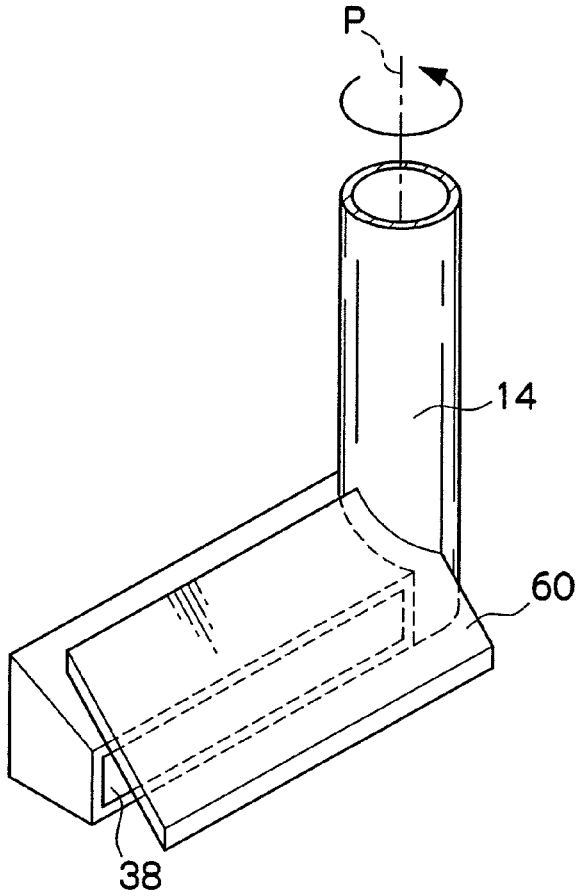
FIG. 4 is a perspective view showing a mode in which an inclined plate is disposed at the lower suction port of the suction pipe.

FIG. 4 shows an example in which an inclined plate 60 is disposed at the lower suction port 38 of the suction pipe 14.

Figure 5:
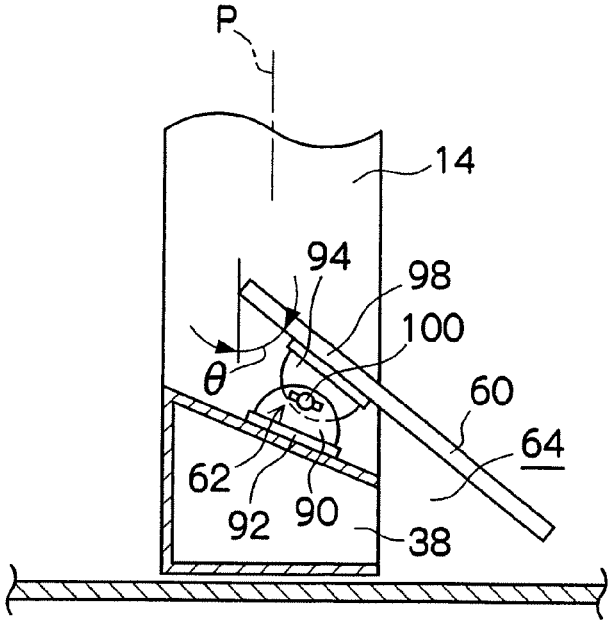
FIG. 5 is a side view of the inclined plate shown in FIG. 4.

The inclined plate 60 is attachably and detachably mounted to a lower portion of the suction pipe 14 by an inclination angle adjusting mechanism 62 shown in FIG. 5, and an inclination angle θ is adjustable.

Figure 6A:
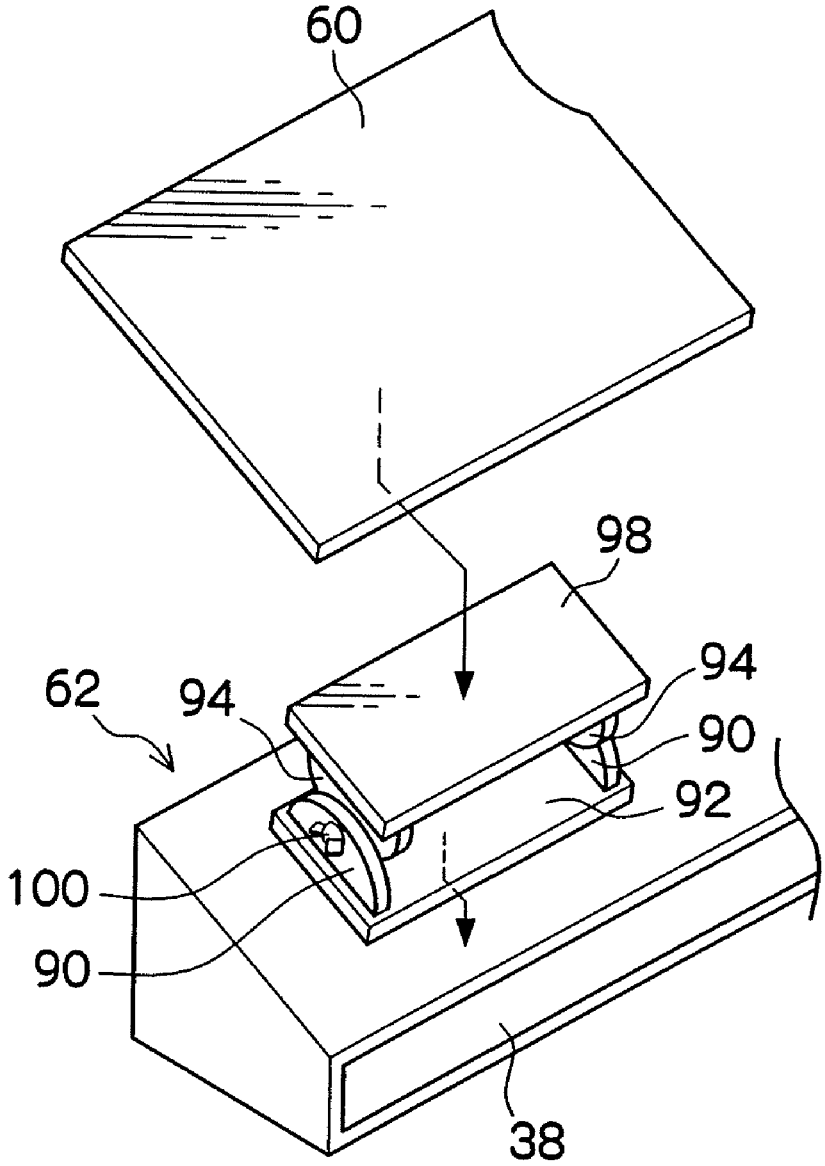
FIGS. 6A and 6B are perspective views of assembly of an inclination angle adjusting mechanism shown in FIG. 5.
Figure 6B:
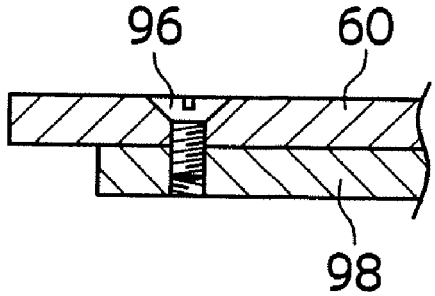

As shown in FIG. 6A, the inclination angle adjusting mechanism 62 includes a base plate 92 which is fixed to an upper wall surface of the lower suction port 38 and has semicircular bearing portions 90 and 90 fixed to both end portions of the base plate 92, and a rocking plate 98 in which semicircular brackets 94 and 94 are fixed to both end portions of the lower portion of the rocking plate 98 and the inclined plate 60 is fixed to it by a flat screw 96 as shown in FIG. 6B. The brackets 94 and 94 are connected to the bearing portions 90 and 90 to be rockable via threads not shown, whereby the inclined plate 60 is tilted via the rocking plate 98, and is held at a predetermined inclination angle by fastening wing nuts 100 which are secured in the above described threads.

As the inclination angle adjusting member of the inclined plate 60, the inclined angle adjusting mechanism 62 is used, but the inclination angle adjusting member is not limited to this, and any member can be used if only it is capable of adjusting the inclination angle of the inclined plate 60.

The inclined plate 60 is disposed to be opposed to the lower suction port 38, and is disposed to incline at the downstream side with respect to the rotating direction of the lower suction port 38. Further, the inclined plate 60 is disposed to be spaced by a predetermined amount from the lower suction portion 38 so as to form a gap 64 between the inclined plate 60 and the lower suction port 38 as shown in FIG. 5.

By disposing the inclined plate 60 at the lower suction port 38 like this, when the suction pipe 14 rotates as the inclined plate 60 is pushing the sponge blast medium 32, the sponge blast medium 32 does not exist in the gap 64 between the back surface of the inclined plate 60 and the lower suction portion 38, and the gap 64 becomes an empty space. Due to the existence of the empty space, suction of the sponge blast medium 32 from the lower suction port 38 easily occurs. Thereby, by providing the inclined plate 60, the sponge blast medium 32 can be stably sucked. This action is similar in the case of the blast media other than the sponge blast media 32.

The inclined plate 60 is adjustable in the inclination angle θ by the inclination angle adjusting mechanism 62, and therefore, in accordance with the kind of the blast medium for use (sand, steel, and sponge), the inclination angle of the inclined plate 60 can be set at an angle at which the blast medium is easily sucked.

Figure 7:
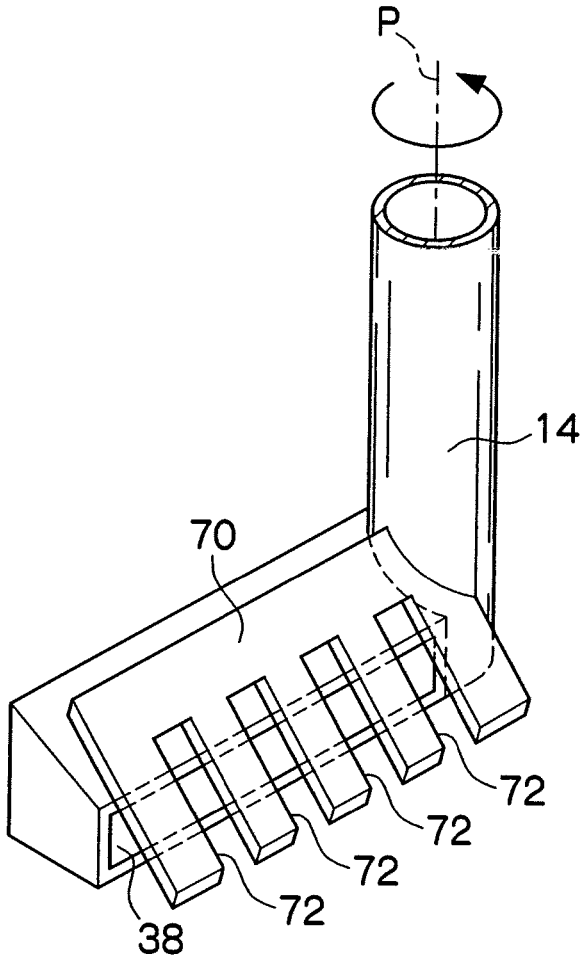
FIG. 7 is a perspective view showing a mode in which a comb-shaped inclined plate is disposed at the lower suction port of the suction pipe.

FIG. 7 shows an example in which an inclined plate 70 in the shape of comb teeth is disposed at the lower suction port 38 of the suction pipe 14. In this mode, the blast medium can be taken into the above described gap 64 (see FIG. 5) from gaps 72, 72, . . . between the comb teeth of the inclination plate 70. In this case, the blast media such as sand and steel are not preferable since the above described gap 64 is clogged, but in the case of the sponge blast medium 32, it is preferable since the above described gap 64 is not completely clogged, and the sponge blast medium 32 is loosened by the comb teeth.

Figure 8:
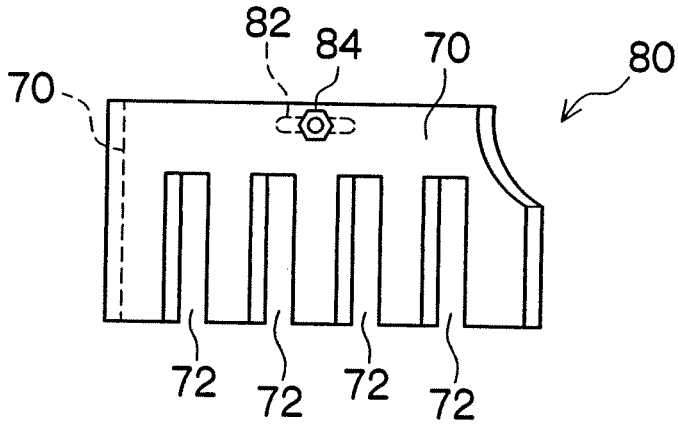
FIG. 8 is a plane view showing a mode in which two comb-shaped inclined plates are disposed to be stacked in layers and slidable.

FIG. 8 is a plane view of an inclined plate unit 80 in which the two inclined plates 70 and 70 in the shapes of comb teeth are disposed in layer to be slidable.

In the inclined plate unit 80 shown in the drawing, through a long hole 82 formed in one inclined plate 70, a bolt 84 mounted to the other inclined plate 70 is inserted, and thereby, the two inclined plates 70 and 70 are slidably jointed with the long hole 82 and the bolt 84 as a guide. By relatively sliding these inclined plates 70 and 70, the size (opening area) of the gaps 72 between the comb teeth can be adjusted as shown in FIG. 8. After adjustment, by fastening a nut (not shown) to the bolt 84, the size of the gaps 72 between the comb teeth can be kept. By making the size of the gaps 72 between the comb teeth of the inclined plate 70 variable like this, the suction rate of the blast medium, especially, the sponge blast medium 32 can be controlled. In this embodiment, as the opening area changing device, the sliding structure using the two inclined plates 70 and 70, and connecting them with the long hole 82 and the bolt 84 is shown as an example, but the opening area changing device is not limited to this, and any device is applicable if only it can change the size of the gaps 72 between the comb teeth of the inclined plate 70.

What is claimed is:

1. A blasting device, comprising:

a container in which a blast medium is stored;

a suction pipe which is inserted in the container to be rotatably supported, and is formed substantially in an L-shape with a lower suction port bent at a right angle;

a rotary drive part which rotates the suction pipe;

a hose connected to the suction pipe via a rotary joint;

an ejector nozzle connected to the hose;

an air compressor which supplies compressed air to the ejector nozzle;

a pressure sensor which measures pressure in the suction pipe; and a control part which controls a rotational frequency of the suction pipe by the rotary drive mechanism based on a measured value by the pressure sensor.

2. The blasting device according to claim 1 further comprising:

an inclined plate disposed at the lower suction port of the suction pipe to be spaced by a predetermined amount, and disposed to be inclined at a downstream side with respect to a rotating direction of the lower suction port.

3. The blasting device according to claim 2 further comprising:

an adjusting member which adjusts an inclination angle of the inclined plate.

4. The blasting device according to claim 3 wherein the inclined plate is formed into a comb shape.

5. The blasting device according to claim 4, further comprising:

an opening area changing device which makes an opening area between comb teeth portions of the inclined plate variable.

6. The blasting device according to claim 1, wherein the control part conducts control to supply compressed air from the air compressor to a part of the hose other than the ejector nozzle as supplementary compressed air to suck the blast medium in the suction pipe by an ejector effect to feed it into the hose when the measured value by the pressure sensor exceeds a predetermined value, and conducts control to stop the supply of the supplementary compressed air to the hose when the measured value by the pressure sensor becomes the predetermined value or less.

7. A blasting device, comprising:

a container in which a blast medium is stored;

a suction pipe which is inserted in the container to be rotatably supported, and is formed substantially in an L-shape with a lower suction port bent at a right angle;

a rotary drive part which rotates the suction pipe;

a hose connected to the suction pipe via a rotary joint;

an ejector nozzle connected to the hose;

an air compressor which supplies compressed air to the ejector nozzle; and an inclined plate disposed at the lower suction port of the suction pipe to be spaced by a predetermined amount, and disposed to be inclined at a downstream side with respect to a rotating direction of the lower suction port.

8. The blasting device according to claim 7 further comprising:

an adjusting member which adjusts an inclination angle of the inclined plate.

9. The blasting device according to claim 8, wherein the control part conducts control to supply compressed air from the air compressor to a part of the hose other than the ejector nozzle as supplementary compressed air to suck the blast medium in the suction pipe by an ejector effect to feed it into the hose when the measured value by the pressure sensor exceeds a predetermined value, and conducts control to stop the supply of the supplementary compressed air to the hose when the measured value by the pressure sensor becomes the predetermined value or less.

10. The blasting device according to claim 8 wherein the inclined plate is formed into a comb shape.

11. The blasting device according to claim 10, wherein the control part conducts control to supply compressed air from the air compressor to a part of the hose other than the ejector nozzle as supplementary compressed air to suck the blast medium in the suction pipe by an ejector effect to feed it into the hose when the measured value by the pressure sensor exceeds a predetermined value, and conducts control to stop the supply of the supplementary compressed air to the hose when the measured value by the pressure sensor becomes the predetermined value or less.

12. The blasting device according to claim 10, further comprising:

an opening area changing device which makes an opening area between comb teeth portions of the inclined plate variable.

13. The blasting device according to claim 12, wherein the control part conducts control to supply compressed air from the air compressor to a part of the hose other than the ejector nozzle as supplementary compressed air to suck the blast medium in the suction pipe by an ejector effect to feed it into the hose when the measured value by the pressure sensor exceeds a predetermined value, and conducts control to stop the supply of the supplementary compressed air to the hose when the measured value by the pressure sensor becomes the predetermined value or less.

14. The blasting device according to claim 7, wherein the control part conducts control to supply compressed air from the air compressor to a part of the hose other than the ejector nozzle as supplementary compressed air to suck the blast medium in the suction pipe by an ejector effect to feed it into the hose when the measured value by the pressure sensor exceeds a predetermined value, and conducts control to stop the supply of the supplementary compressed air to the hose when the measured value by the pressure sensor becomes the predetermined value or less.

* * * * *